US006561446B2

(12) United States Patent
Okabe

(10) Patent No.: US 6,561,446 B2
(45) Date of Patent: May 13, 2003

(54) DEVICE FOR SUPPLYING AND DISCHARGING POWDER PARTICLES

(75) Inventor: Shuji Okabe, 1-18-26, Kaminishi, Hirano-ku, Osaka (JP)

(73) Assignees: Agru Japan Company, LImited, Atsugi (JP); Keiichiro Kohmitsu, Osaka (JP); Shuji Okabe, Osaka (JP)

( * ) Notice: Subject to any disclaimer, the term of this patent is extended or adjusted under 35 U.S.C. 154(b) by 0 days.

(21) Appl. No.: 09/835,680

(22) Filed: Apr. 16, 2001

(65) Prior Publication Data

US 2001/0038051 A1 Nov. 8, 2001

(30) Foreign Application Priority Data

Apr. 25, 2000 (JP) ..... 2000-124237

(51) Int. Cl.[7] ..... B02C 19/00
(52) U.S. Cl. ..... 241/94; 241/283
(58) Field of Search ..... 241/94, 283

(56) References Cited

U.S. PATENT DOCUMENTS 3,823,881 A * 7/1974 Grob ..... 241/283
4,580,732 A * 4/1986 Mantell ..... 241/262
5,082,187 A * 1/1992 Kirchhoff et al. ..... 241/262
5,340,038 A * 8/1994 Omann ..... 241/205

* cited by examiner

*Primary Examiner*—Mark Rosenbaum
(74) *Attorney, Agent, or Firm*—Moonray Kojima

(57) ABSTRACT

A device for supplying and discharging powder particles, wherein the amount of powder particles being supplied and discharged is controlled by holding the particles in a reserve container having an outlet with a plurality of control parts disposed on supporting parts and designed to be shaken from a shaking position so that the particles in the reserve container is supplied and discharged into the outlet from between the control parts, thereby making the device simpler and smaller and reducing powder requirements and maintenance costs. Advantageously, particle size and other properties thereof, such as cohesiveness, flushing ability, types can be adjusted for by controlling the shape of the control parts, distance spaces, and vibration. Also, the device can function as sieve to remove alien material larger than the distance between the control parts.

11 Claims, 10 Drawing Sheets

DEVICE FOR SUPPLYING AND DISCHARGING POWDER PARTICLES

BACKGROUND OF THE INVENTION

1. Field of the Invention

This invention relates to a device for supplying and discharging powder particles capable of controlling the amount of the powder particles which are going to fall to be supplied and discharged, wherein titan oxide, flour, granulated sugar, $CaCO_3$ (calcium carbonate), other powders, medical products, food additives, glues, pigments, and other granulated particles and resin pellets, glass beads, lumber chips, gravel-like materials and other particles are reserved in a reserving container.

2. Description of the Prior Art

As a conventional device for supplying and discharging powder particles, there is one type, according to which a device for supplying and discharging powder particles is provided between a reserving container like a hopper and the final outlet (a supplying part or a discharging part) and this device for supplying and discharging powder particles includes a drum-like electromagnetic feeder, a screw feeder, a belt feeder, a table feeder for continuously supplying and discharging powder particles and also a rotary feeder, a rotary valve, a double dumper and the like for intermittently supplying and discharging powder particles. These devices must vary in respect of the structure as a device for supplying and discharging powder particles because of the particle size of the powder particles, cohesiveness, properties like a flushing property and differences of types, involving in any case a problem of an expensive and large machinery and in terms of its structure, a large power would be needed, easily destroying the device by mixture of alien materials because of no sieve function or disabling supply and discharge, wherein, if the amount of the supply and discharge increases, powder particles become susceptible to damages by pressure or friction and when supplying and discharging operations were over, a remaining amount of the particle powders in a reserving container would be much.

SUMMARY OF THE INVENTION

The main purpose of the present invention is to provide a device for supplying and discharging particle powders, capable of making the structure simpler and the device smaller, cutting down on the power needed, thus reducing the running costs like preventing the loss of the devices, operations of supplying and discharging becoming ready to be adjusted according to the shape, distant spaces, vibrations and materials of the control part in terms of particle size of powders, cohesiveness, properties like flushing properties and different types, being able to supply and discharge the powder particles being dispersed without adding unnecessary force to the powder particles while removing alien materials larger than the distant spaces between the control parts with a function of the sieve, wherein there is provided a plurality of control parts on the supporting part between the reserving container and the outlet, shaking the said control parts from the point of the shaking origin, thus supplying and discharging the powder particles from the reserving container into the outlet through the distant spaces pertaining to the control parts.

Another purpose of the present invention is to provide a device for supplying and discharging powder particles, capable of adjusting the above said spaces between the control parts according to the types of the powder particles and its fluidity by having a space-adjusting means to adjust the distant spaces between the control parts.

Furthermore, another purpose of the present invention is to provided a device for supplying and discharging powder particles, capable of readily preventing the bridge or arching which may arise on the inner wall of the reserving container, by having vibration-communicating means to communicate the vibration from the origin of vibration into the reserving container.

Furthermore, another purpose of the present invention is to provide a device for supplying and discharging powder particles, capable of assuring the so called steel-powder-removing effects, which remove steel powders from the above said powder particles when supplying and discharging the powder particles by adding the magnetic functions to at least one part of the control parts.

In addition, other purposes of the present invention will be easily clarified according to the examples set forth below.

DESCRIPTION OF THE PREFERRED EMBODIMENT

Figure 1:
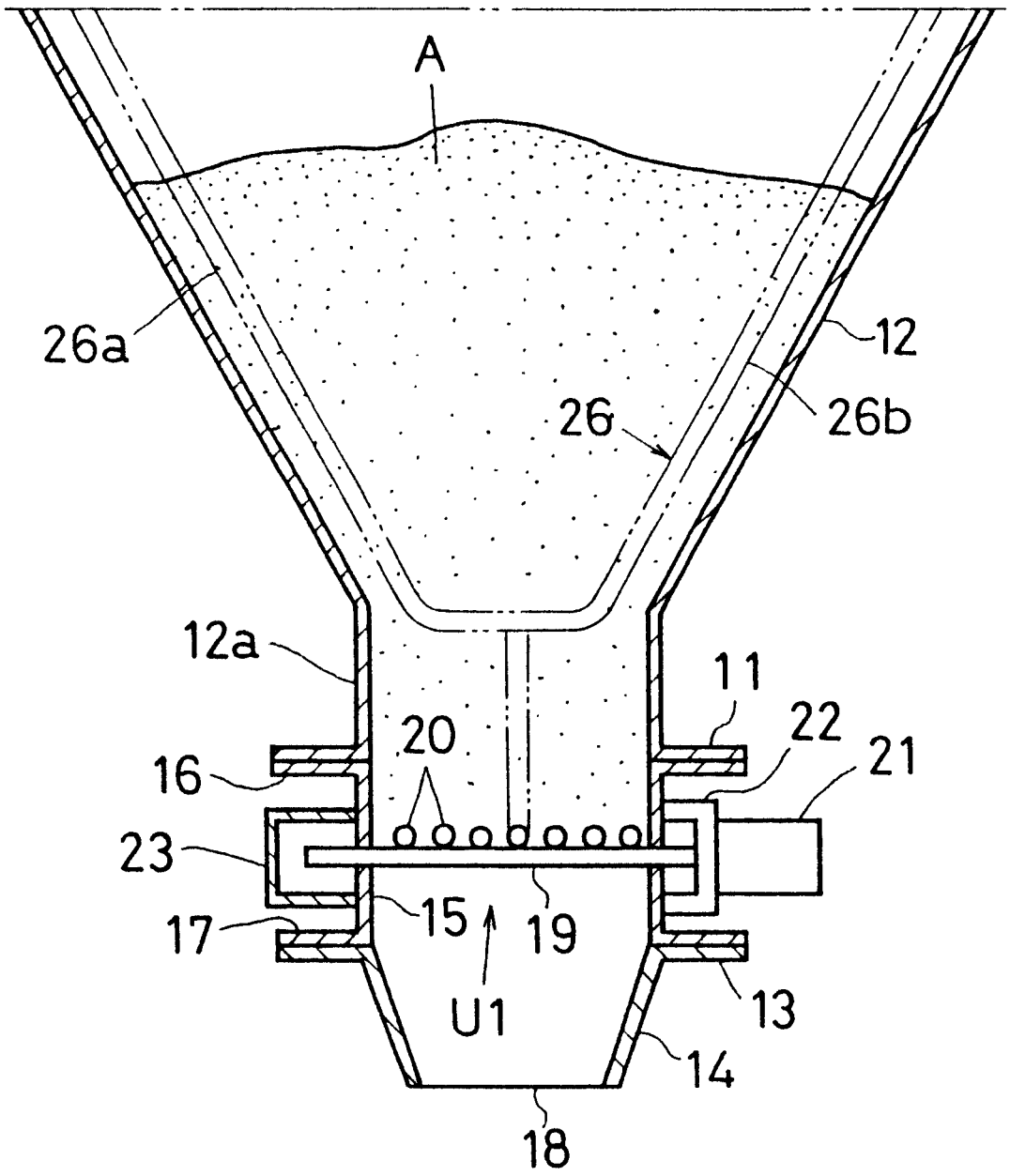
FIG. 1 is a cross sectional view of the device for supplying and discharging the powder particles of the present invention.

One preferred embodiment of the present invention will be clarified using the below figures.

The figures show a device for supplying and discharging powder particles and according to the FIG. 1, there are provided the hopper 12 having the flange 11 on the below part and the outlet housing 14 having the flange 13 on the upper part.

In addition, there is provided the housing 15 for the control parts, installed between the hopper 12 and the outlet housing 14, wherein, on the upper and below parts of the housing 15, there are formed the flanges 16 and 17 together or almost together.

In this way, by connecting each of the flanges 11, 16, 17 and 13, there are constructed the inner part of the hopper 12 and the inner part of the housing 15 for the control parts, the inner part of the outlet housing 14 and the outlet 18, all of these connecting with each other from the top to the bottom.

Figure 3:
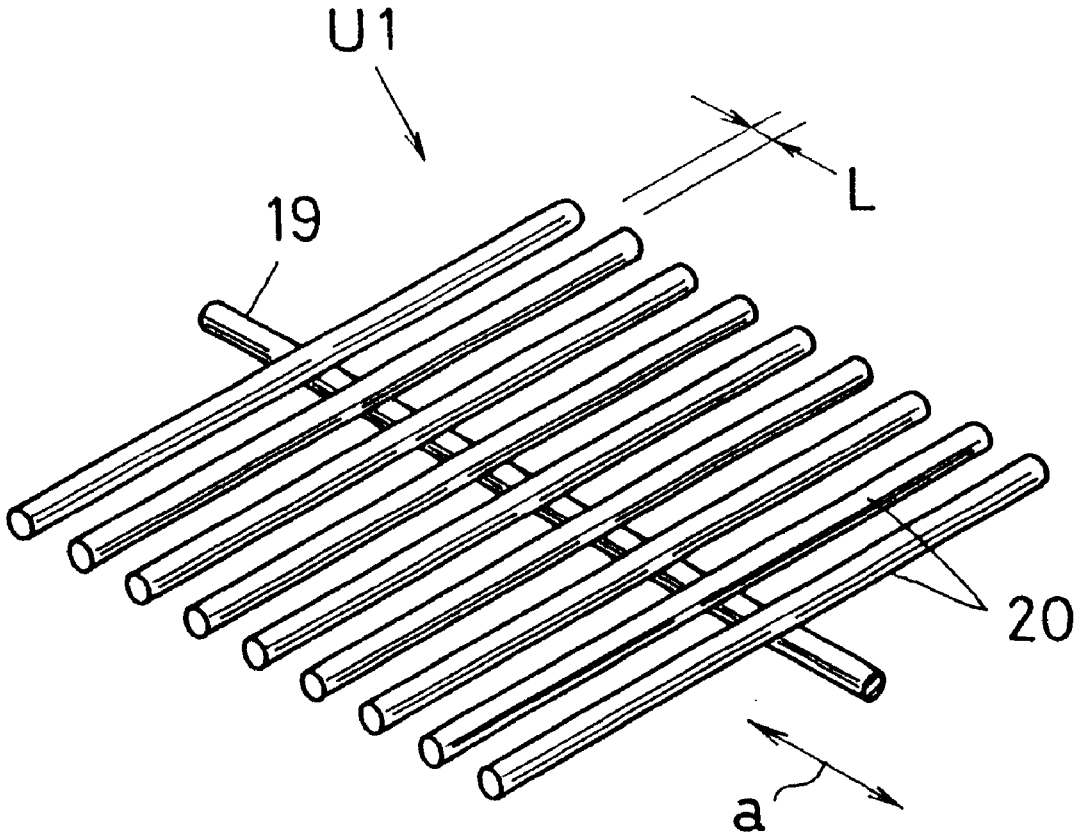
FIG. 3 is a perspective view of the important parts of the FIG. 2.

Inside the housing 15 for the control parts, there is provided a supporting rod 19 as a supporting part extending roughly horizontally as shown in the FIG. 3 and on the upper part of the supporting rod 19 there is installed a plurality of shaking rods 20 and so on as control parts, which are horizontal and in parallel, thus forming the distant space L between those installed shaking rods 20, 20, each of which is in parallel with each other.

At this stage, the supporting rod 19 is supported by the housing 15 for the control parts on both of its ends in such a way that it can move, while extending from the said housing 15 outwardly, wherein, to one end of this supporting rod 19 is connected the vibrator 21 (a device which shakes,) as an origin of vibration. In addition, the vibrator 21 is installed by means of the setting plate 22 of the brackets on the outer surface of the housing 15 for the control parts, wherein the supporting rod 19 and other protruding parts are surrounded by the covering part 23.

Figure 2:
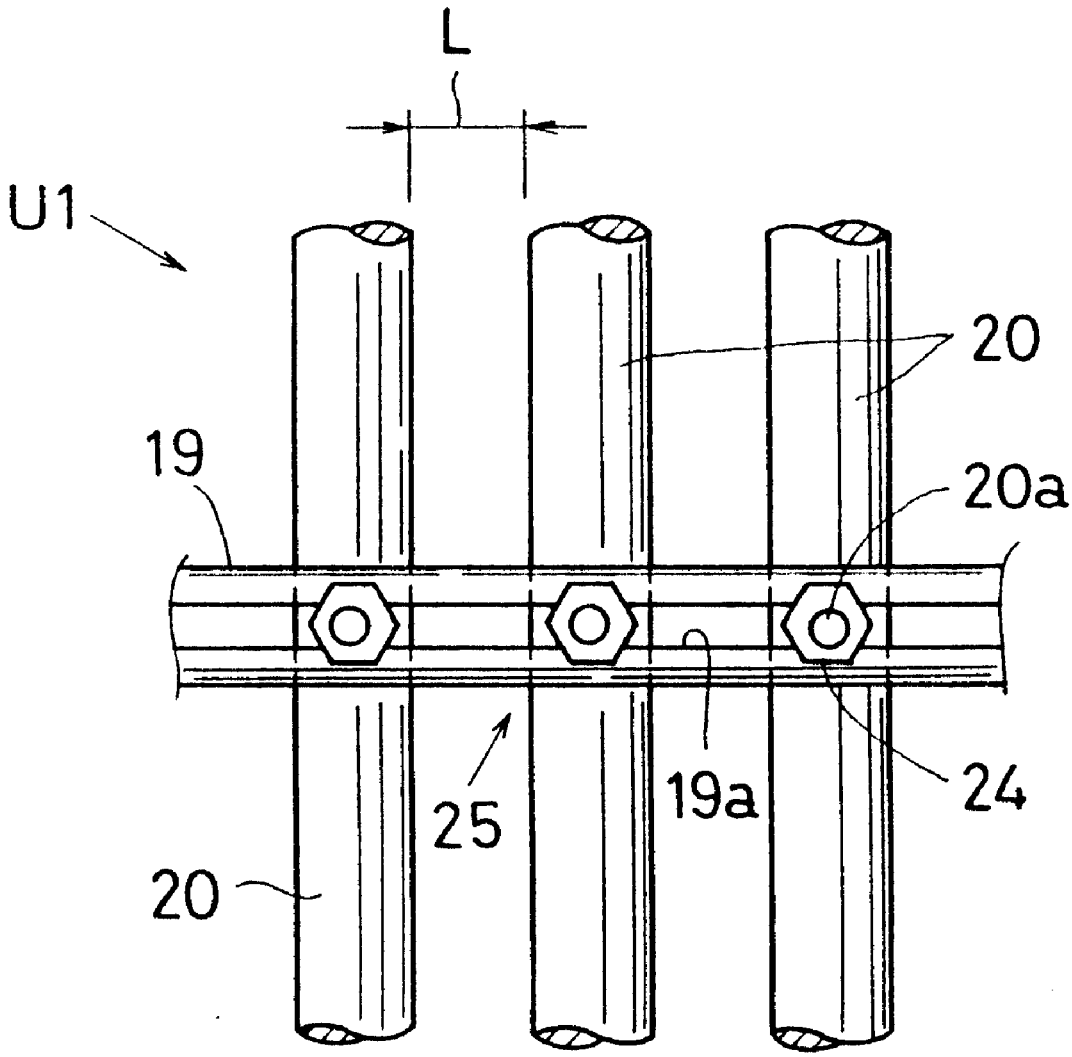
FIG. 2 is a bottom plan view of the important parts of the FIG. 1.

As in the bottom plan view of the FIG. 2, on the supporting rod 19 there is formed a long hole 19*a* along the vertical direction in the middle of the same rod, while on the lower part of the shaking rod 20 there is provided an attaching screw 20*a* together, thus perforating the attaching screw 20*a* through the long hole 19*a* and by screwing the nut 24 to the attaching screw 20*a*, the distance space L between the shaking rods 20,20 is designed to be adjusted freely, depending on the properties of the powder particles A.

In other words, according to the example in the FIG. 2, there is provided the space-adjusting means 25 to adjust the distant space L between a plurality of the control parts (see the shaking rod 20) by means of each element, namely 19*a*, 20*a*, 24.

Furthermore, the shaking rod 20 or the supporting rod 19 is provided with the vibration-communicating part 26 roughly in the shape of the letter Y and both sides, right and left of this vibration-communicating part 26, namely 26*a* and 26*b* are provided adjacently onto the inner wall of the hopper 12.

In addition, the below part 12*a* of the hopper 12 is formed in the shape of a cylinder and the housing 15 for the controlling part is formed in the shape of a corn, however the scope of the present invention is not limited to these shapes.

Now, as the shaking rod 20 and the vibration-communicating part 26, a round bar, a square bar, a round pipe and a square pipe can be used, but for the convenience of the illustration, in the related figure a round bar structure is shown.

In addition, the whole part of the shaking rod 20 may be formed of magnet steel like MK steel or steel amalgam added with Cr, Ni, Al, W and others, while the above said magnetic steel or everlasting magnet may be installed into one part of the shaking rod, but in any case, a magnetic function may be added to at least one part of the control part.

The effects of the device for supplying and discharging powder particles, thus constructed, will be more particularly described below.

Inside the hopper 12, titan oxide, flour, granulated sugar, $CaCO_3$(calcium carbonate) and any one of other powder particles A will be reserved in advance.

Furthermore, the distant space L varies depending on the properties like the particle size of the powders A or cohesiveness, however, the distance may as well be selected between 0.3 mm to 30 mm approximately.

In order to supply a determined amount of the powder particle A inside the hopper 12 through the outlet 18, the vibrator 21 will be driven so that the shaking rod 19 and shaking rods 20 and so on will be shaken from one side to another repeatedly in a horizontal direction as shown with the sign a in the FIG. 3.

When the shaking rod 20 moves from one side to another repeatedly in a horizontal direction, the powder particles A inside the hopper 12 will be dissolved, breaking the bridge so that the powder particle A will fall down to be supplied through the distant space L between the shaking rods 20, 20.

At this moment, by adjusting the width and number of vibrations pertaining to the shaking rod 20, a determined amount of the powder particles to be supplied will be assured. At the same time, the more rapidly the shaking rod is shaken, the more the amount of the powder particles to be supplied will be, wherein the larger the width of vibrations or the stroke is, the larger the amount of the powder particles to be supplied will be.

In order to stop the supply and fall of the powder particle A, the vibration of the shaking rods 20 and so on may be stopped. When the vibrations of the shaking rod 20 are stopped, the powder particles A will be immediately condensed and consequently the supply and fall of the powder particles will be stopped even though there is a distant space L between the shaking rods 20, 20.

In this way, the device for supplying and discharging the powder particles of the examples shown in the FIGS. 1 to 3 is a device for supplying and discharging the powder particles capable of controlling the amount of the powder particles A to be supplied from the outlet 18 which powder particles have been reserved in a reserving container (see the hopper 12), wherein, between the reserving container (see the hopper 12) and the outlet 18 there is provided a plurality of controlling parts (see the shaking rod 20) installed on the supporting part (see the supporting rod 19) and the control part (see the shaking rod 20) is shaken from one side to another repeatedly in a horizontal direction from the shaking origin (see the vibrator 21) in such a way that the powder particles A of the reserving container (see the hopper 12) fall to be supplied and discharged into the outlet 18 through the distant sp ace L of the controlling part (see the shaking rod 20).

Therefore, when the control part (see the shaking rod 20) is shaken from the shaking origin (see the vibrator 21), the bridging of the powder particle A inside the reserving container (see the hopper 12) is broken and the powder particles A can fall into the outlet 18 and be supplied from the distant space L between each of the control parts (see the shaking rods 20) and when the shaking is stopped, the powder particles get condensed immediately while stopping the supply and fall of the same powder particles.

As described above, the structure is such that there are provided only the supporting part (see the supporting rod 19), the control part (see the shaking rod 20) and the shaking origin (see the vibrator 21), thus making the structure simpler and the device smaller, while being able to reduce the moving power and cut down on the running costs like preventing the loss of the machinery, and the effects of supplying and discharging the powder particles in terms of the particle size of the powders, cohesiveness, properties like a flushing property and different types will be adjusted with the shape of the control part, distant spaces, vibrations and lumber materials and the powder particles can be supplied and discharged while being dispersed, without adding unnecessary force to the powder particles, wherein, with a function of a sieve, it is possible to remove (or prevent the falling of) alien materials even when those alien materials lager than the distant spaces of the control parts (see the shaking rod 20) are mixed into the powder particles A.

Furthermore, it is possible to assure the determined amount of the powder particles to be supplied, by adjusting the width and the number of the vibrations of the controlling part.

As there is provided a distant space-adjusting means 25 (see the FIG. 2) for adjusting the distant space L of a plurality of the control parts (see the shaking rod 20), the distant space L can be adjusted by the above said distant space-adjusting means 25 in terms of the types of the powder particles A, its fluidity, cohesiveness and other elements.

In addition, as there is provided a vibration communicating means (see the vibration communicating part 26) for communicating vibrations from the shaking origin (see the vibrator 21) into the reserving container (see the hopper 12), the vibrations are to be transmitted into the reserving container (see the hopper 12), especially the areas around its inner wall through the vibration communicating means (see the vibration communicating means 26) when the origin of vibration (see the vibrator 21) is shaken so that it is possible to prevent readily the bridge arising on the inner surface of the wall of the reserving container (see the hopper 12).

In addition, at least a part of the control parts (see the shaking rod 20) is provided with the magnet function so that it is possible to remove the steel powders from the powder particles A when supplying and discharging (while dropping to supply) the particle powders A, thus assuring the effects of removing steel powders.

Furthermore, the feeder unit U1 comprising each element of 19, 20 and 21 is provided with a plurality of steps from above to down, more preferably in a so called crossing direction of ninety degrees of difference in the plane vie w in respect of the installing angle, thus elevating the controlling precision of the supply amount of the powder particles A. This can also be applied to other units U2, U3 set forth below.

Figure 4:
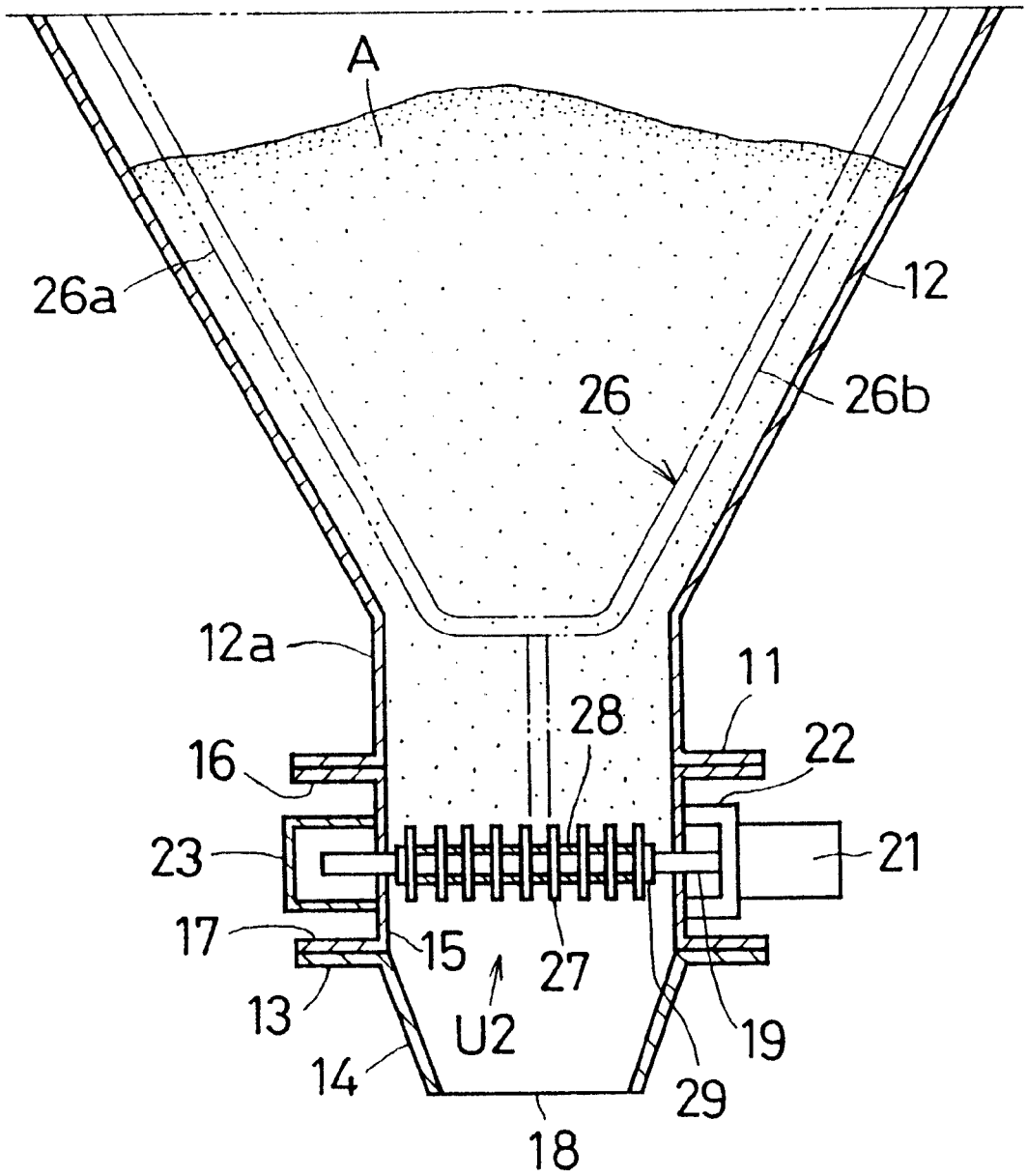
FIG. 4 is a cross sectional view of another example of the device for supplying and discharging powder particles of the present invention.
Figure 5:
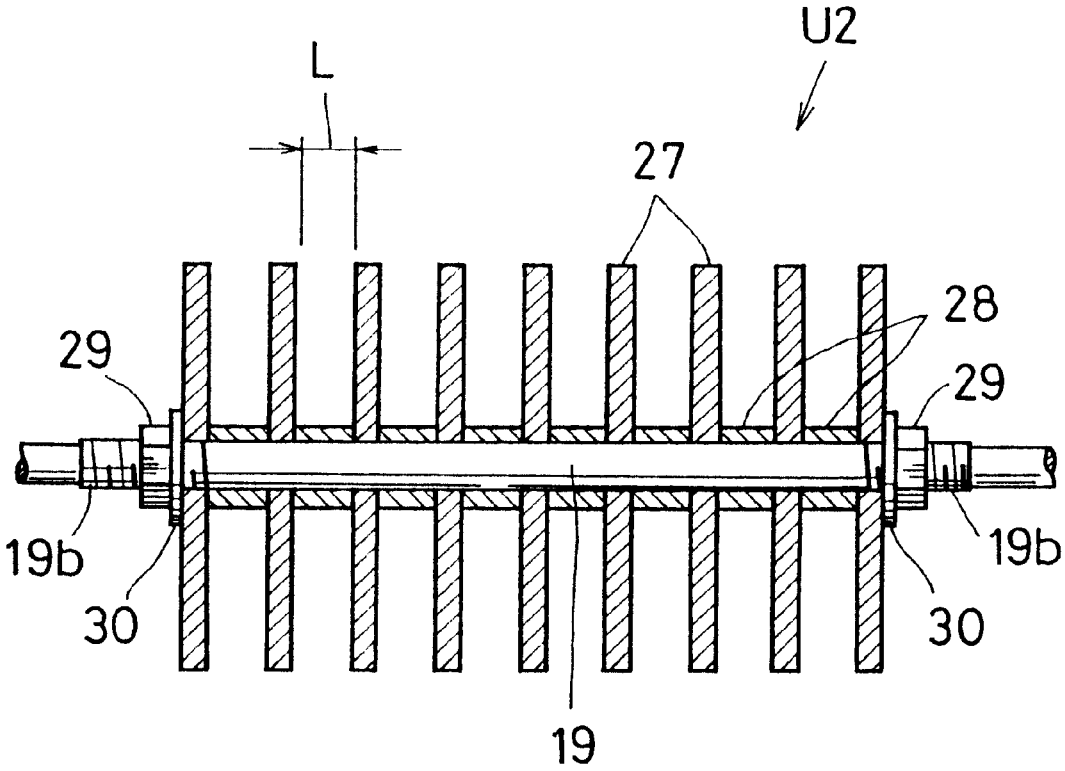
FIG. 5 is a cross sectional view magnifying the important parts of the FIG. 4.
Figure 6:
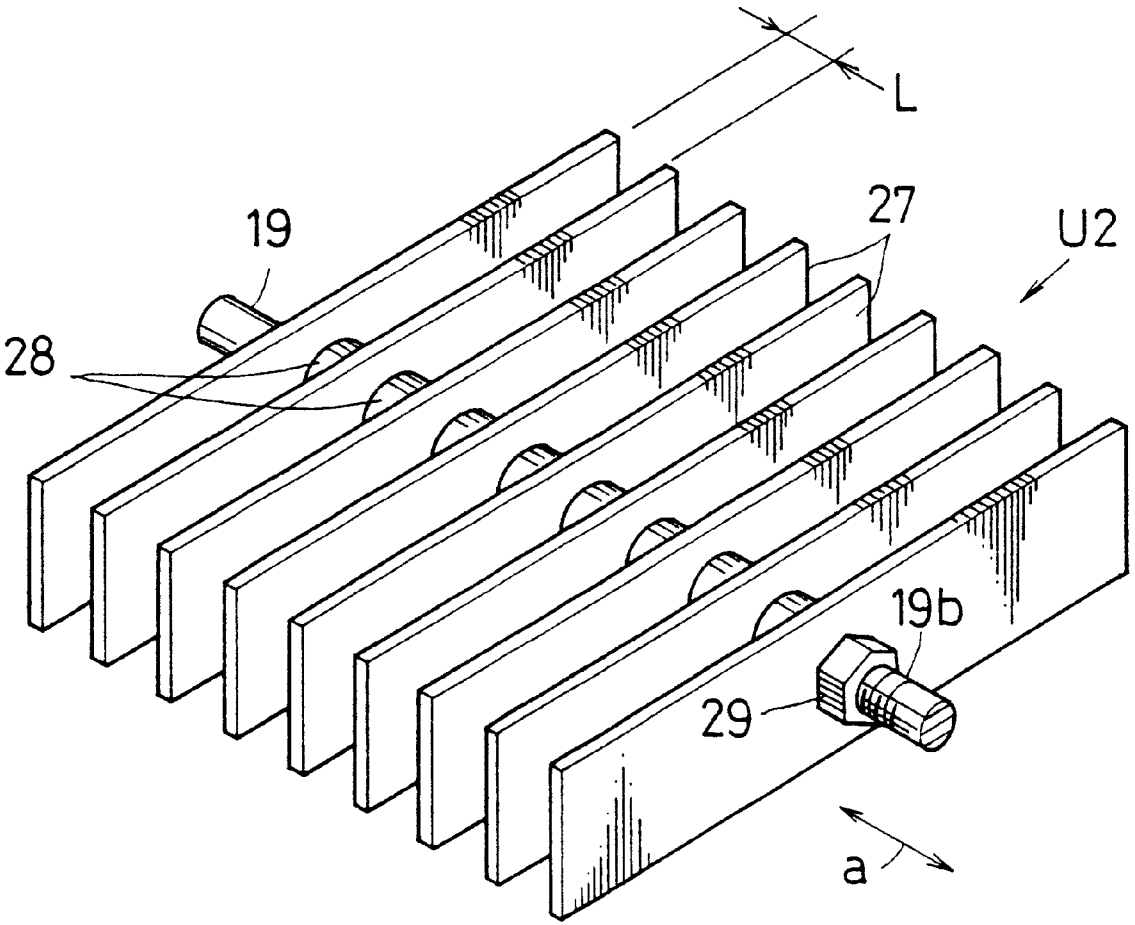
FIG. 6 is a perspective view of the important parts of the FIG. 4.

The FIGS. 4, 5 and 6 show other examples of the device for supplying and discharging powder particles. According to this example, onto the supporting rod 19 whose one end is connected to the vibrator 21, there are installed a plurality of plates, namely the vibrating plates 27 and so on with the main surfaces facing each other, wherein the collar 28 or a spacer is provided between each of the vibrating plates 27, 27 as a distant space-adjusting part.

In addition, on both sides of the supporting rod 19 there are formed screw parts 19*b*, 19*b*, and by means of the nuts 29, 29 (the tightening devices) for screwing the above said screw parts 19*b*, 19*b* of both sides of a plurality of collars 28 and a plurality of vibrating plates 27, each element of 27 and 28 is tightened, thus constructing the feeder unit U2. In addition, the number 30 in the figure indicates a washer. In this step, the nut 29 may be a double-nut structure according to the necessities.

The collar 28 can be replaced by other collars of a different length or can be changed in terms of the number of the collars to be provided so that the distant space L between the vibrating plates 27, 27 can be arbitrarily adjusted while a shim may be also used to the collar 28.

Even though thus constructed, other structures, operations and effects are roughly the same as in the examples shown in the foregoing FIGS. 1 to 3 so that the same signs are put for the same parts in the FIGS. 4 to 6 as in the previous figures and more particular explanations will be omitted, however, the preferred embodiment shown in the FIGS. 1 to 3 and another preferred embodiment shown in the FIGS. 4 to 6 are all appropriate for the control of the cohesive materials (so called wet powder particles) among the powder particles A.

Figure 7:
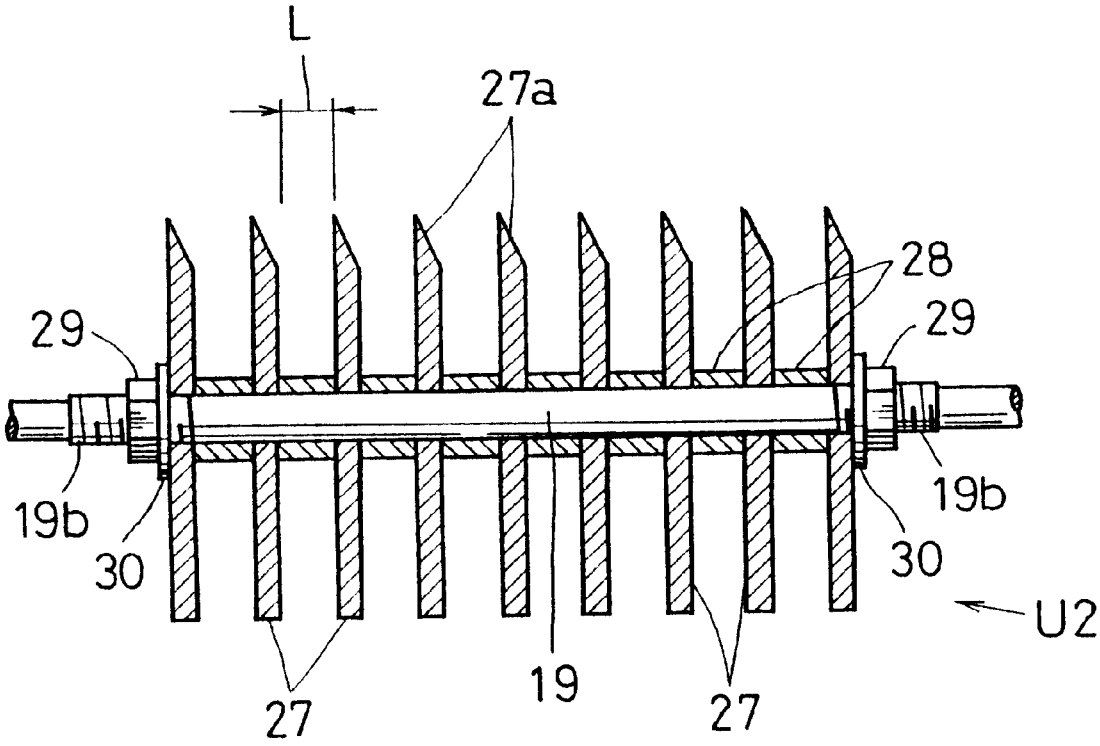
FIG. 7 is a cross sectional view of other more examples of the device for supplying and discharging particles of the present invention.

The FIG. 7 shows another example of the device for supplying and discharging the powder particles, wherein the sharp blade part 27*a* is formed on the above end of each of the vibrating plates 27, together with the construction of the feeder unit U2 shown in the FIG. 5 so that each of the blade part 27*a* is designed to be an element for breaking (or a part for pulverizing) the condensed balls.

As thus constructed, the pressure pertaining to the powder particles put on each of the blade parts 27*a*, combined with the vibration of the blade parts 27*a* is apt to break and pulverize the condensed balls of the powder particles according to the appropriate measure, thus assuring the determined quantity of the powder particles to be discharged and also the pulverization of the condensed balls of the powder particles.

In addition, in the example of the FIG. 7, other structures, operations and effects are the same as in the example of the FIG. 5 so that the same signs are put for the same parts in the FIG. 7 as in the FIG. 5, thus omitting more particular explanations.

Figure 8:
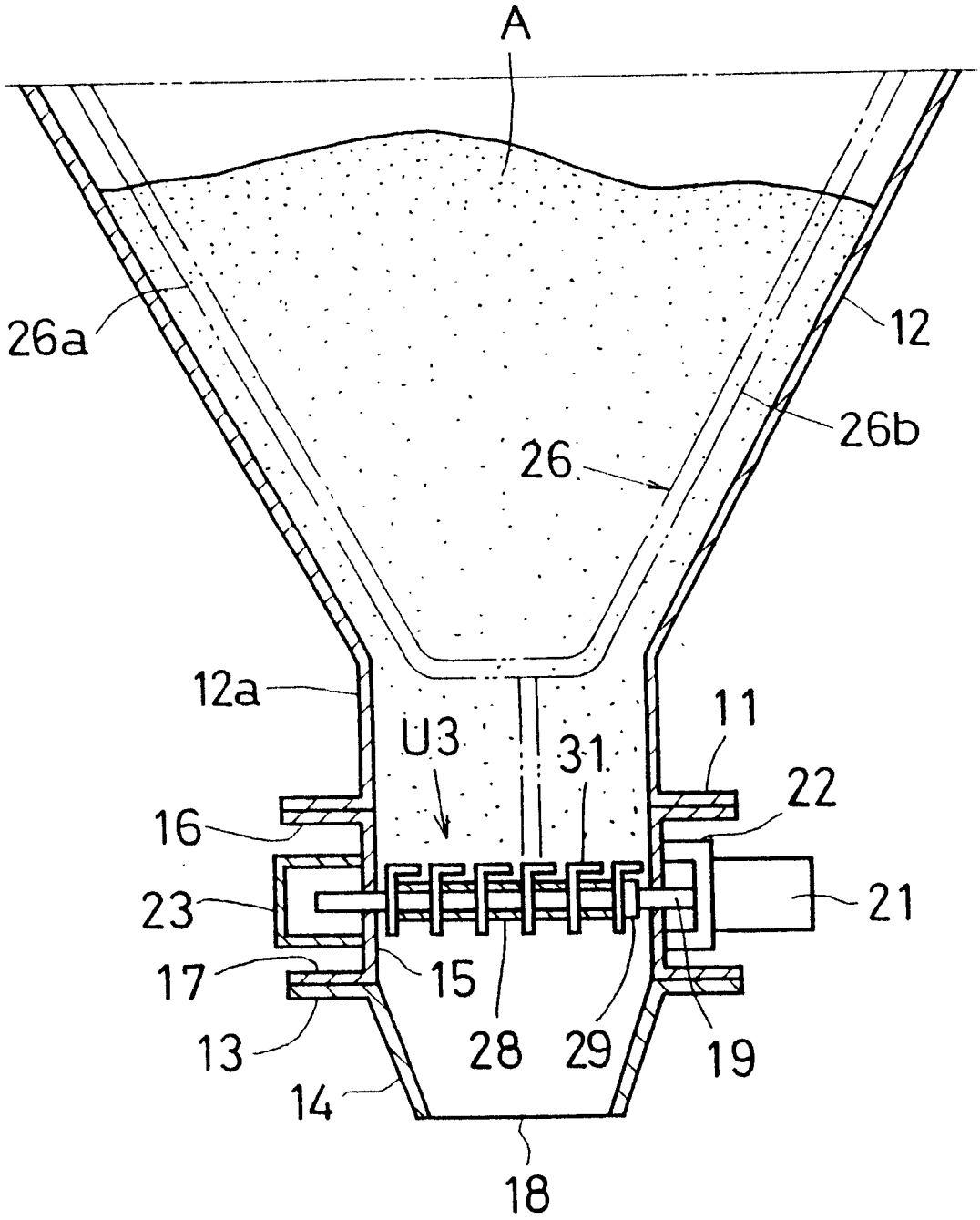
FIG. 8 is a cross sectional view of other more examples of the device for supplying and discharging particles of the present invention.
Figure 9:
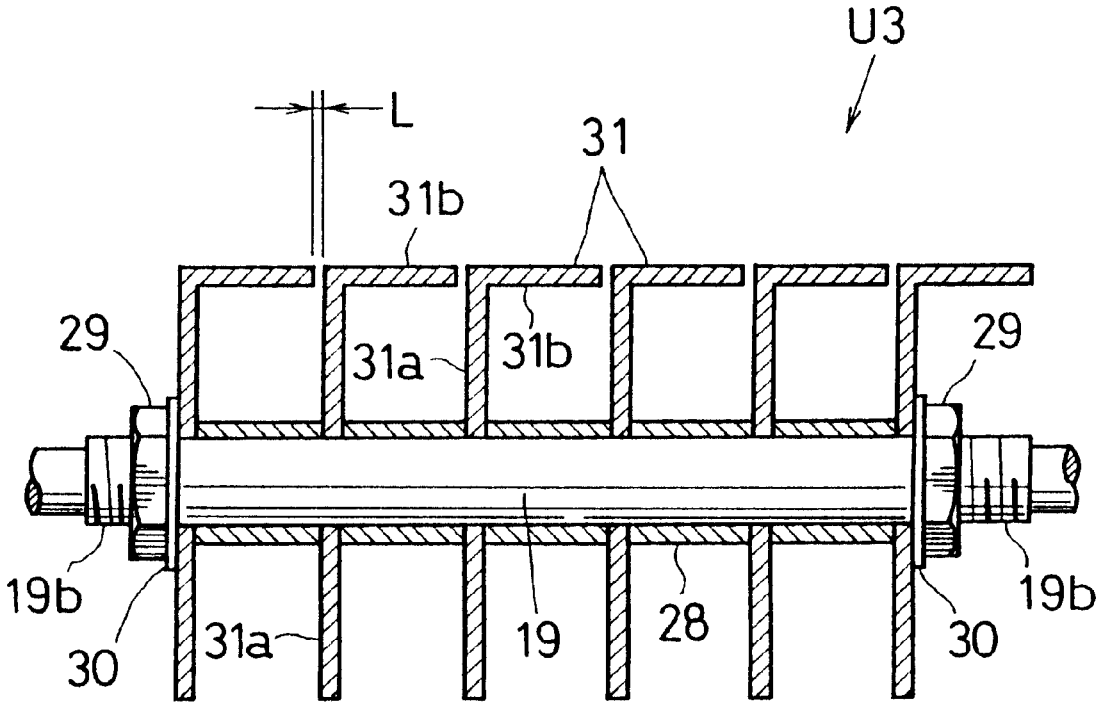
FIG. 9 is a cross sectional view magnifying important parts of the FIG. 8.
Figure 10:
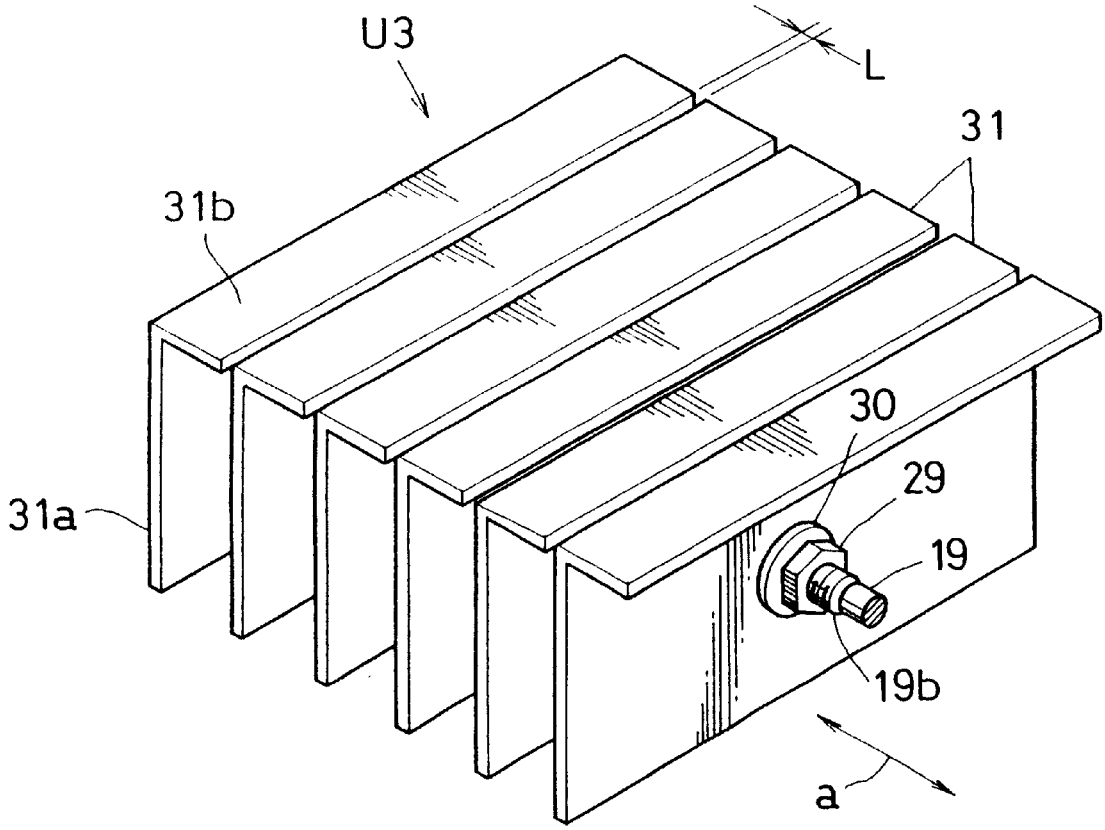
FIG. 10 is a cross sectional view of important parts of the FIG. 8.

The FIGS. 8, 9 and 10 show other examples of the device for supplying and discharging the powder particles, especially the most appropriate example of preventing flushing (prevention of the falling down) of the powder particles and controlling the discharge of the powder particles which are dry, among the powder particles A.

In other words, there is provided the vibrating plate 31 in the shape of the reversed letter L, having the vertical part 31*a*(a vertical wall part) and the horizontal part 31*b*(part for preventing the flushing), wherein the supporting rod 19 which is connected to the vibrator 21 on its one end, is provided with a plurality of the vibrating plates 31 and so on, in such a manner that its vertical parts 31*a* are facing with each other and the horizontal parts 31*b* are located on the above side, forming a collar 28 or a spacer as a distant space-adjusting part between each of the vibrating plates 31, 31.

Furthermore, on both sides of the supporting rod 19, there are formed the screw parts 19*b*, 19*b* like in the examples of the FIGS. 4 to 6, wherein, by means of the nuts 29, 29 for screwing the above said screw parts 19*b*, 19*b* on the both sides of a plurality of collars 28 and a plurality of vibrating plates 31, each element of 28 and 31 will be tightened, thus constructing the feeder unit U3.

In this step, a long collar 28 may be used in relation with the distant space L being formed, thus improving the operation of installing the unit U3.

In addition, by replacing the collar 28 by another collar of a different length or changing the number of collars to install or changing for another vibrating plate 31 of a different length in respect of the length of the horizontal part 31*b*, the distant space L between the vibrating plates 31, 31 can be arbitrarily adjusted. Furthermore, a shim can be used for the collar 28, however, in this example, the above said distant space L has a clearance of approximately 0.3 mm in order to prevent the flushing of the powder particles.

As thus constructed, the prevention of the flushing or control of the dry powder particles, among the powder particles A, to be supplied and discharged, can be done. It is noted that other structures, operations, and effects are roughly the same as in the previous examples so that the same signs are put for the same parts in the FIGS. 8 to 10 as in the previous figures, thus omitting more particular explanations.

According to the structure of the present invention and in relation with the above-mentioned examples, the reserving container of the present invention corresponds to the hopper 12 of the preferred embodiment and thus, the powder particles A corresponding to titan oxide, flour, granulated sugar, $CaCO_3$(calcium carbonate) and other powder particles and the supporting part corresponding to the supporting rod 19, the control part corresponding to the vibrating rod 20, vibrating plate 27 and vibrating plate 31, wherein the vibrating origin corresponds to the vibrator 21, as the distant space-adjusting means corresponds to the distant space-adjusting means 25 or a collar 28 comprising each element of 19*a*, 20*a* and 24 and the vibration-communicating means corresponds to the vibration-communicating part 26, however, the scope of the present invention may not be limited to the structure of the above-mentioned preferred embodiment.

For instance, in replacement of the structure of horizontally moving from one side to another the control part, it may be constructed in such a way as to move in an oval way. To add, when the feeder units U1, U2 and U3 are driven or only when the control part is vibrated, the control part may be preferably electrified and magnetized to form the electromagnetic structure. In addition, according to the above-mentioned preferred embodiment, there is shown a structure using one supporting rod 19 only as a supporting part, however, a plurality of the supporting rods of this kind may be used.

According to the device for supplying and discharging the powder particles of the above-mentioned example, when the powder particles fall between the distant spaces pertaining to each of the control parts, the condensed ball of the above said powder particles are pulverized by vibration, thus the said device is appropriate for supplying sticky materials like glues and also it may be used for supplying into other installments of different powder particles or disperse-supply of the powder particles against some liquid and other purposes.

To summarize the above, according to the device of the present invention for supplying and discharging the powder particles, between the reserving container and the outlet there are provided a plurality of the control parts installed on the supporting parts, wherein the above said control parts are designed to be shaken from the shaking origin so that the powder particles in the reserving container will be supplied and discharged into the outlet from between the control parts, thus making the structure simpler and the device smaller, while reducing the moving force and cutting down on the running costs like preventing the loss of the machinery and the effects of supplying and discharging the powder particles in terms of the particle size of the powders, cohesiveness, properties like a flushing property and different types will be adjusted with the shape of the control part, distant spaces, vibrations and lumber materials and the powder particles can be supplied and discharged while being dispersed, without adding unnecessary force to the powder particles, wherein, with a function of a sieve, it is possible to remove alien materials larger than the distant spaces of the control parts.

What is claimed is:

1. A device for storing and discharging particles, said device comprising:

a container for storing said particles, said container comprising a top through which said particles are inserted, a bottom through which said particles are discharged, and container walls connecting said top and said bottom;

vibration means comprising a portion which is disposed within and adjacent to said walls of said container;

a plurality of control means disposed adjacent to said bottom of said container; and moving means connected to said vibration means and to said plurality of control means for causing concurrent vibration of said vibration means and said plurality of control means so that substantially all of said particles stored in said container are selectively discharged from said container through said bottom and said plurality of control means.

2. The device of claim 1, wherein said plurality of control means comprise a plurality of parallely disposed plates, and means for adjusting spaces between said plurality of parallely disposed plates.

3. The device of claim 1 wherein said plurality of control means comprises magnetic means for directing magnetic material contained in said particles.

4. The device of claim 1, wherein said plurality of control means comprise a plurality of parallely disposed circular rods.

5. The device of claim 1, wherein said plurality of control means comprise a plurality of parallely disposed blades, each having a saw tooth end.

6. The device of claim 1, wherein said plurality of control means comprise a plurality of "L" shaped blades.

7. The device of claim 1, wherein said vibration means comprise vibration walls having generally the same shape as said container walls of said container, and means for connecting said vibration walls to said moving means.

8. A device for supplying and discharging powder and particles comprising:

a reserving part for holding powder and particles;

an outlet;

a bridge formed by condensation of said powder and said particles;

means for oscillating and destroying said bridge to supply said powder and particles from said outlet in a given quantity;

a plurality of control parts disposed in parallel and between said reserving part and said outlet;

an oscillating source;

means for causing said oscillating source to oscillate each of said plurality of control parts in an almost crosswise direction with an oscillating direction so that said powder and particles in said reserving part are supplied from a gap between said plurality of control parts into said outlet in a given quantity.

9. The device of claim 5, further comprising means for adjusting distance between said plurality of control parts.

10. The device of claim 5, further comprising means for communicating vibration from a vibration origin into said reserving part.

11. The device of claim 5, wherein said plurality of control parts comprises at least one part having a magnetic function.

* * * * *